US007382321B1

(12) United States Patent
Qin

(10) Patent No.: US 7,382,321 B1
(45) Date of Patent: Jun. 3, 2008

(54) BROADBAND ANTENNA

(75) Inventor: Xiang-Hong Qin, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/616,900

(22) Filed: Dec. 28, 2006

(30) Foreign Application Priority Data

Nov. 10, 2006 (CN) ..... 2006 1 0063580

(51) Int. Cl.
*H01Q 1/38* (2006.01)
*H01Q 13/12* (2006.01)
*H01Q 1/48* (2006.01)

(52) U.S. Cl. ..... 343/700 MS; 343/769; 343/848

(58) Field of Classification Search ..... 343/700 MS, 343/769, 846, 848
See application file for complete search history.

(56) References Cited

U.S. PATENT DOCUMENTS 5,055,852 A * 10/1991 Dusseux et al. ..... 343/725
5,548,297 A * 8/1996 Arai ..... 343/700 MS
5,675,346 A * 10/1997 Nishikawa et al. .. 343/700 MS
2004/0252056 A1 12/2004 Chen et al.

* cited by examiner

*Primary Examiner*—Shih-Chao Chen
(74) *Attorney, Agent, or Firm*—Wei Te Chung

(57) ABSTRACT

A broadband antenna includes a radiation part (10) for radiating and receiving electromagnetic signals, a feed portion (30) for feeding the electromagnetic signals, and a pair of ground planes (40) respectively disposed on sides of the feed portion. The radiation part comprises an annular first radiation segment (12) and an annular second radiation segment (14) being inscribed within a space defined by the annular shape of the first radiation segment. The feed portion is electrically connected to the radiation part.

12 Claims, 18 Drawing Sheets

BROADBAND ANTENNA

BACKGROUND OF THE INVENTION

1. Field of the Invention

The present invention relates to an antenna, and particularly to a broadband antenna.

2. Description of Related Art

Nowadays, main transmitting modes of wireless local area networks (WLAN) comprise IEEE802.11a, IEEE802.11b, and IEEE802.11g. In addition, with development of wireless communication technology, IEEE802.11n, as a new generation transmitting mode for WLANs, is destined to be compatible with the current transmitting modes for WLANs. That is, it is destined that the IEEE802.11n will be able to operate in both the 2.4~2.5 GHz band of IEEE802.11b and IEEE802.11g, and the 4.9~5.85 GHz band of IEEE802.11a. Therefore, an antenna that can operate in both the 2.4~2.5 GHz and 4.9~5.85 GHz bands is needed.

Therefore, a heretofore unaddressed need exists in the industry to overcome the aforementioned deficiencies and inadequacies.

SUMMARY OF THE INVENTION

In one exemplary embodiment of the invention, a broadband antenna includes a radiation part for radiating and receiving electromagnetic signals, a feed portion for feeding the electromagnetic signals, and a pair of ground planes respectively disposed on sides of the feed portion. The radiation part comprises an annular first radiation segment, and an annular radiation segment being inscribed in the first radiation segment. The feed portion is electrically connected to the radiation part.

In another exemplary embodiment of the present invention, a broadband antenna includes a radiation part for radiating and receiving electromagnetic signals, a feed portion for feeding the electromagnetic signals to the radiation part, and a pair of ground planes respectively disposed on sides of the feed portion. The radiation part comprises an annular first radiation segment, and a zonal second radiation segment disposed within a space defined by the annular shape of the first radiation segment. The feed portion electrically connects with the radiation part. The second radiation segment extends from a part of the first radiation segment.

In a third exemplary embodiment of the present invention, a broadband antenna comprises a radiation part for radiating and receiving electromagnetic signals, a feed portion electrically connecting with the radiation part, and a pair of ground planes respectively disposed on sides of the feed portion. The radiation segment comprises an annular first radiation segment, and a second radiation segment disposed within a space defined by the annular shape of the first radiation segment. The second radiation segment is separated from the first radiation segment and a slot is formed between the first radiation segment and the second radiation segment. The feed portion electrically connects with the radiation part.

Other advantages and novel features will become more apparent from the following detailed description when taken in conjunction with the accompanying drawings, in which:

DETAILED DESCRIPTION OF THE INVENTION

Figure 1:
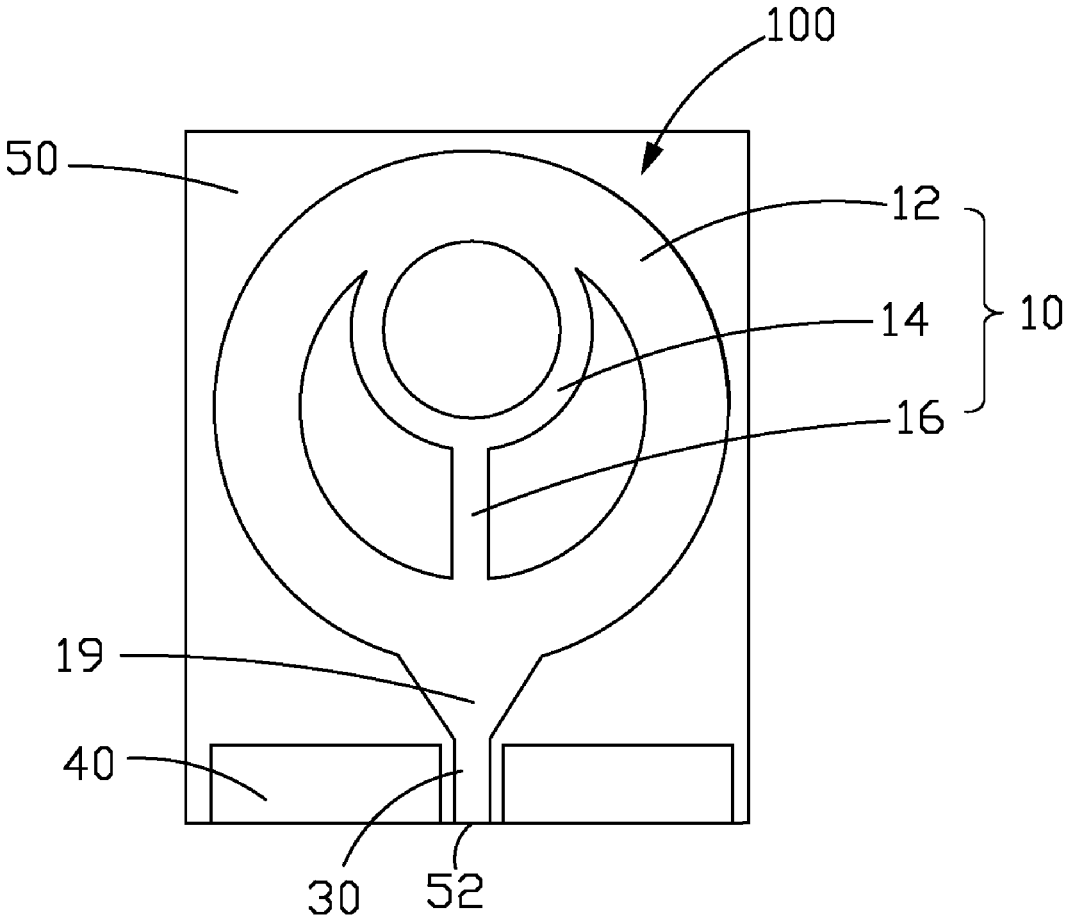
FIG. 1 is a schematic plan view of a broadband antenna of a first exemplary embodiment of the present invention.

Referring to FIG. 1, a broadband antenna 100 of a first exemplary embodiment of the present invention, disposed on a surface of a substrate 50, includes a radiation part 10, a feed portion 30, and a pair of rectangular ground planes 40. The feed portion 30 and the ground planes 40 both extend from an edge 52 of the substrate 50. The feed portion 30 is for feeding the electromagnetic signals to the radiation part 10 and is electrically connected to the radiation part 10. The two ground planes 40 are disposed on sides of the feed portion 30 respectively, for improving radiation efficiency of the broadband antenna 100.

The radiation part 10 is for radiating and receiving electromagnetic signals, and comprises a first radiation segment 12 and a second radiation segment 14. The first radiation segment 12 is annular, and the second radiation segment 14 is also annular and is disposed within a space defined by the annular shape of the first radiation segment 12. A center of the first radiation segment 12 is on an axis of the feed portion 30.

A point of contact of the first radiation segment 12 with the second radiation segment 14 is away from the feed portion 30. The axis of the feed portion 30 passes through a center of the second radiation segment 14 and across the point of contact of the first radiation segment 12 with the second radiation segment 14. The radiation part 10 further comprises a zonal connecting portion 16 disposed outside of the second radiation segment 14 and in the first radiation segment 12, and an axis of the connecting portion 16 is coaxial with the axis of the feed portion 30. Two ends of the connecting portion 16 respectively connect with the first radiation segment 12 and the second radiation segment 14.

The feed portion 30 comprises a cone-shaped matching part 19 formed at an end thereof, for matching impedance of the broadband antenna 100, a wider edge of the feed portion 30 connecting with the first radiation segment 12.

Figure 2:
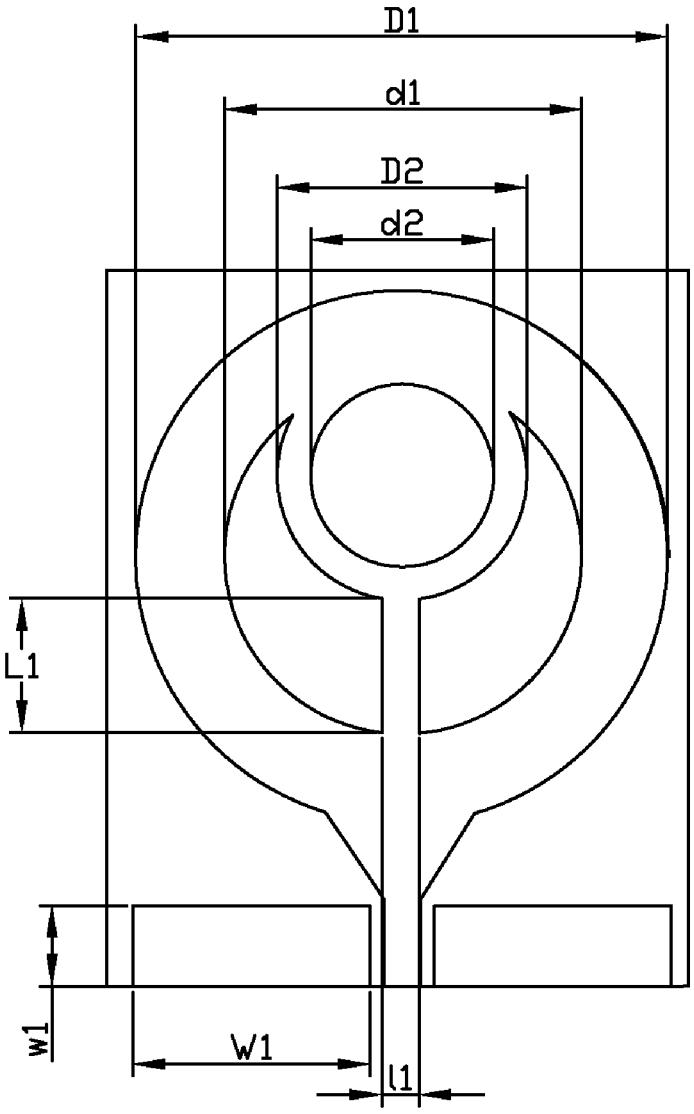
FIG. 2 is a schematic plan view illustrating dimensions of the broadband antenna of FIG. 1.

Referring to FIG. 2, in the exemplary embodiment, an outside diameter D1 of the first radiation segment 12 is about 14.96 millimeter (mm), and an inside diameter d1 is about 10 mm. An outside diameter D2 of the second radiation segment 14 is about 3.5 mm, and an inside diameter d2 of the second radiation segment 14 is about 2.55 mm. A length L1 of the connecting portion 16 is about 3.5 mm, and a width l1 of the connecting portion 16 is about 1.03 mm. A width WI of each of the ground planes 40 is about 6.48 mm, and a length w1 of each of the ground planes 40 is about 2.3 mm.

Figure 3:
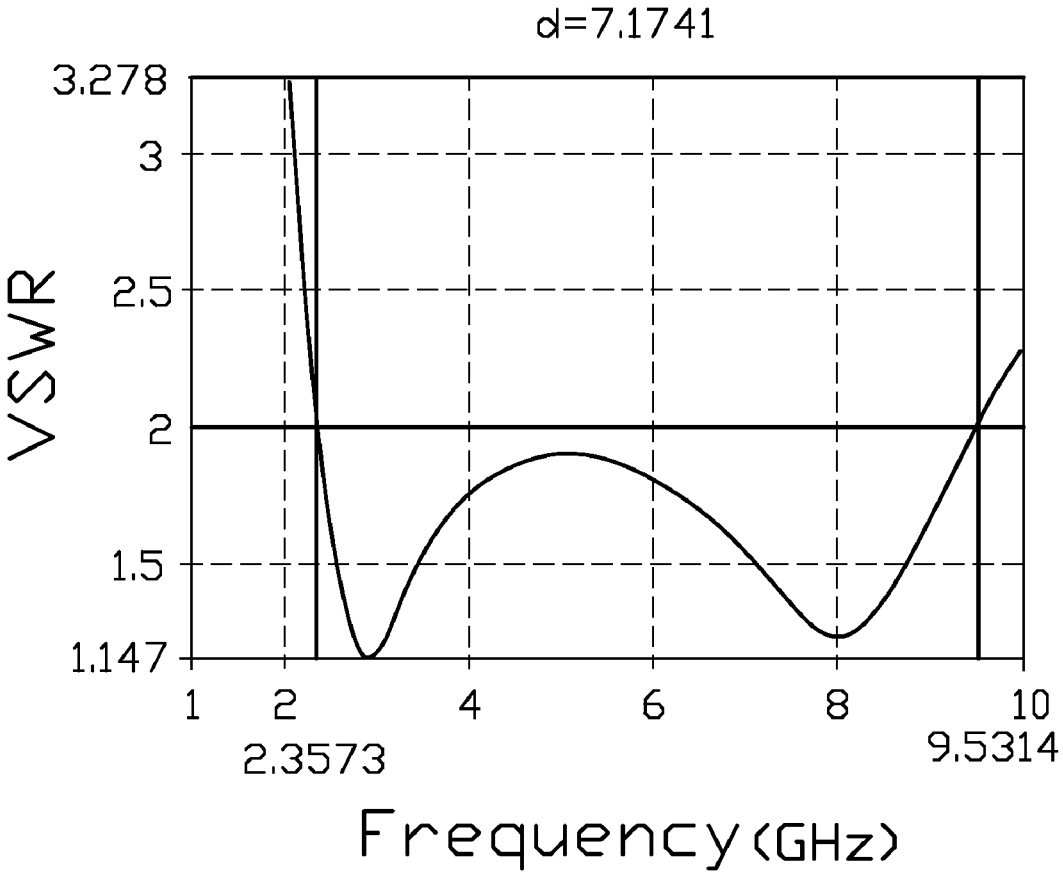
FIG. 3 is a graph of simulated test results showing voltage standing wave ratio (VSWR) of the broadband antenna of FIG. 1.

FIG. 3 is a graph of test results showing voltage standing wave ratio (VSWR) of the broadband antenna 100. A horizontal axis represents the frequency (in GHz) of the electromagnetic signals traveling through the broadband antenna 100, and a vertical axis indicated by a curve represents the amplitude of VSWR of the broadband antenna 100. As shown in FIG. 3, the broadband antenna 100 has a good performance when operating at frequency bands of 2.3573~9.5314 GHz. The amplitude values of the VSWR in the band pass frequency range are smaller than a value of 2, indicating that the broadband antenna 100 complies with application of 802.11n.

Figure 4:
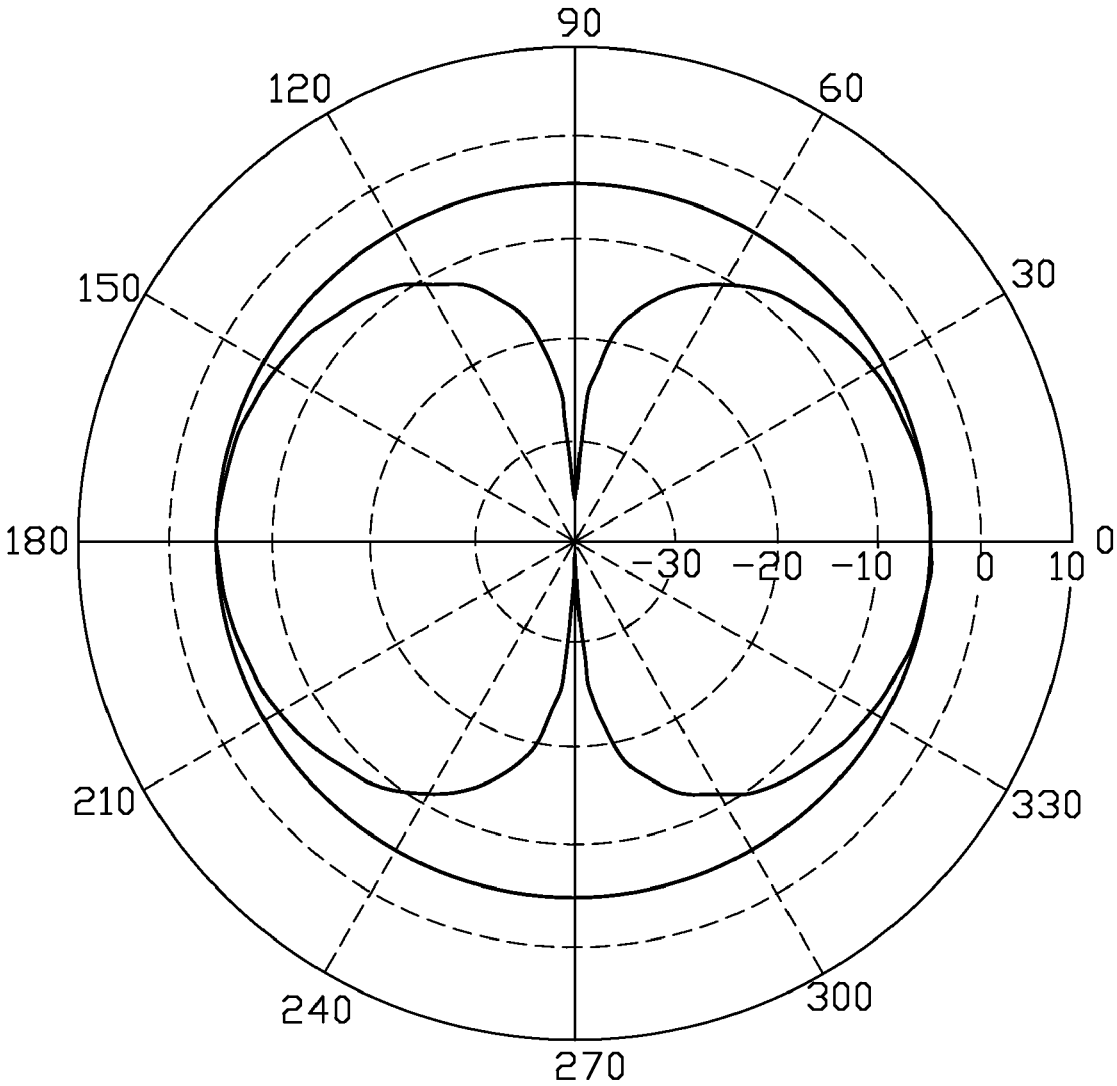
FIG. 4 is a graph of simulated test results showing a radiation pattern when the broadband antenna of FIG. 1 is operated at 2.4 GHz.
Figure 5:
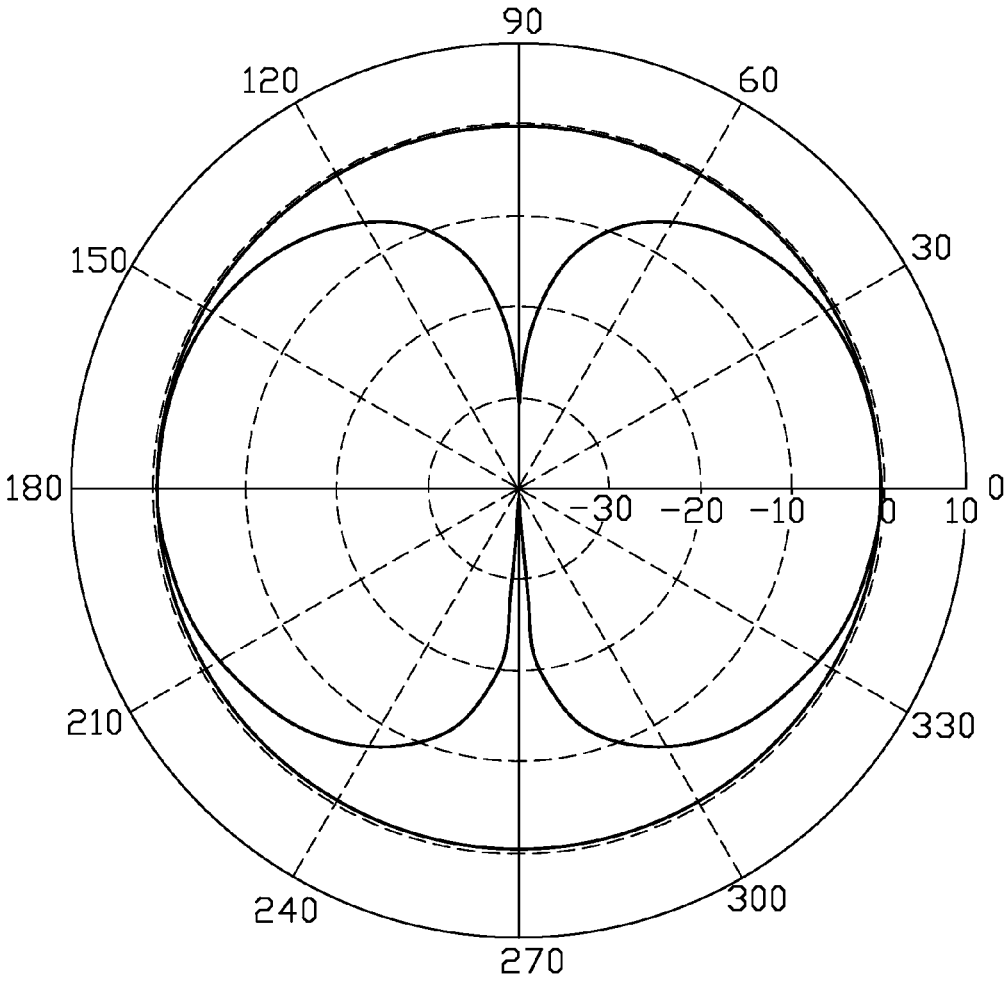
FIG. 5 is a graph of simulated test results showing a radiation pattern when the broadband antenna of FIG. 1 is operated at 4.9 GHz.
Figure 6:
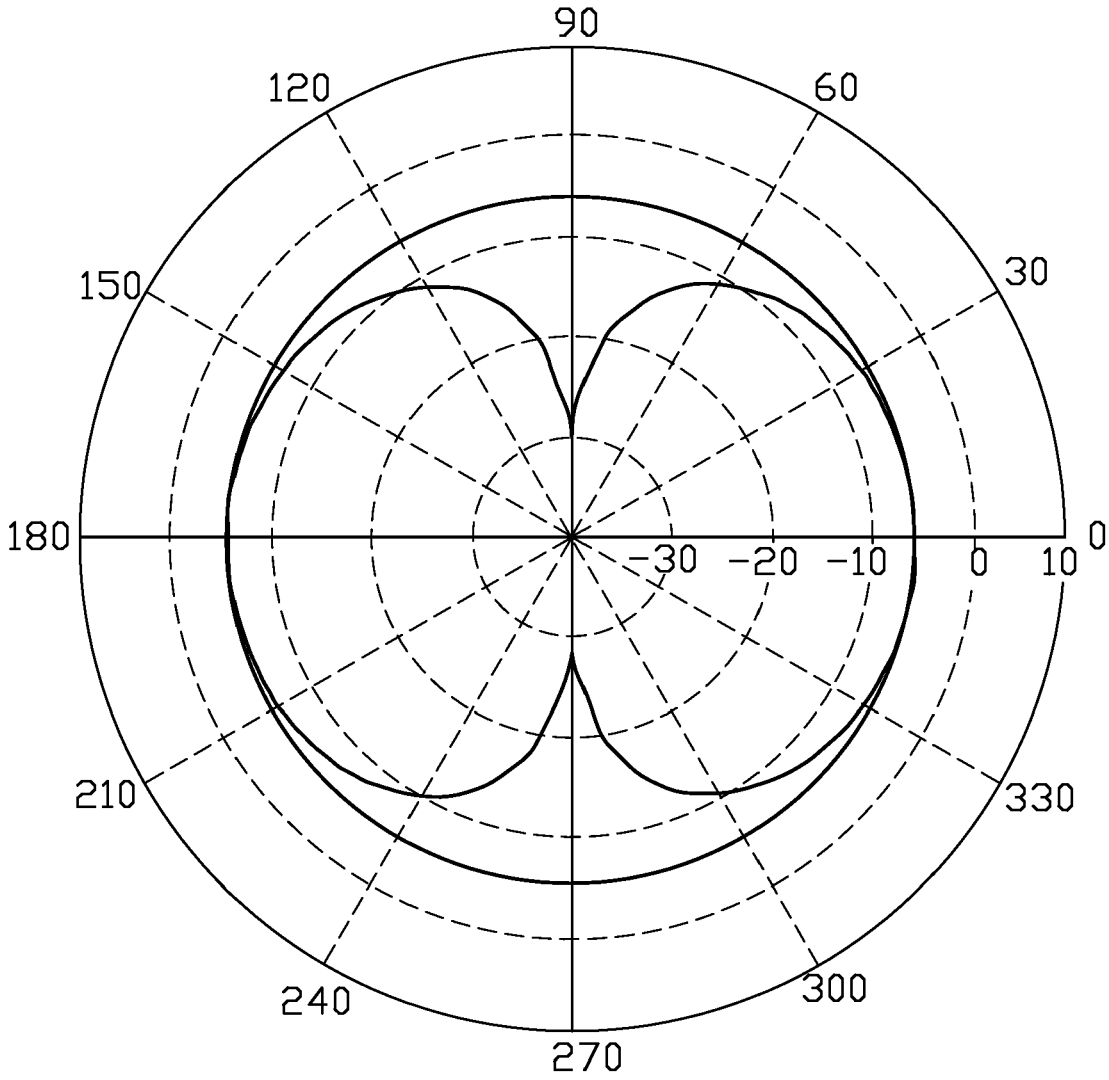
FIG. 6 is a graph of simulated test results showing a radiation pattern when the broadband antenna of FIG. 1 is operated at 6 GHz.

FIGS. 4~6 are graphs of test results showing a simulated radiation pattern in horizontal and vertical planes, when the broadband antenna 100 of FIG. 1 is operated respectively at 2.4 GHz, 4.90 Hz and 6 GHz. It is to be noted that except for a plane where the broadband antenna 100 is placed, the broadband antenna 100 has good radiation performance in each direction.

Figure 7:
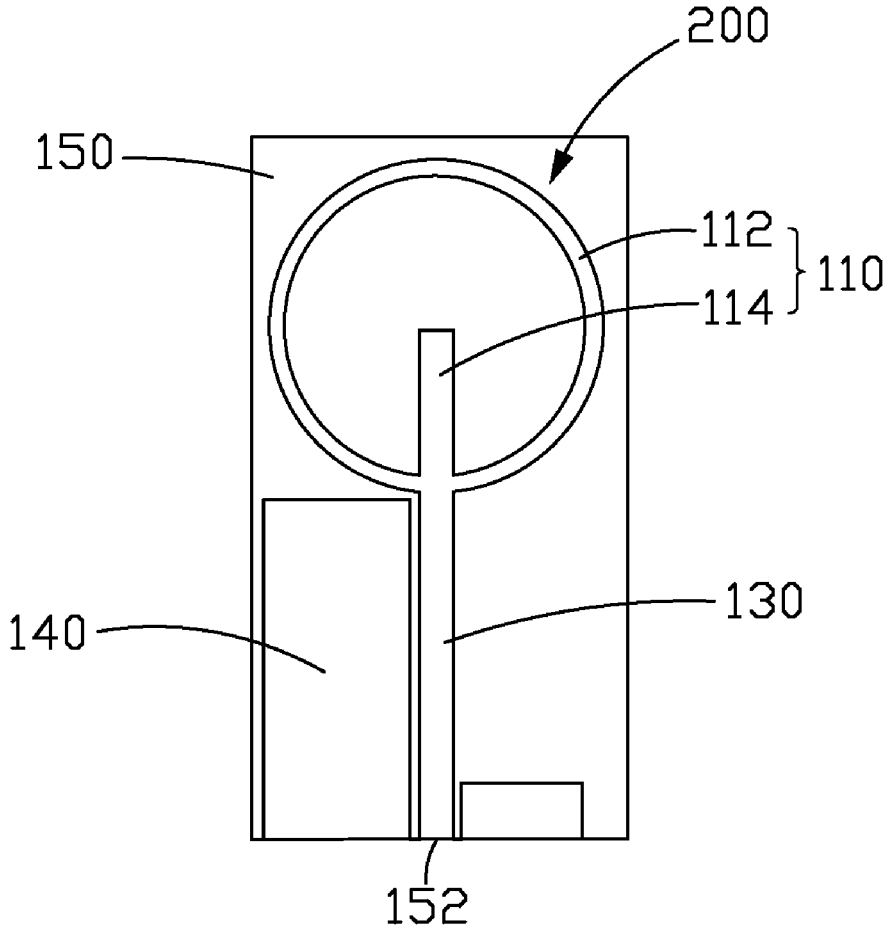
FIG. 7 is a schematic plan view of a broadband antenna of a second exemplary embodiment of the present invention.

Referring to FIG. 7, a broadband antenna 200 of a second embodiment of the present invention is shown. The broadband antenna 200 of the second embodiment is disposed on a substrate 150, and includes a radiation part 110, a feed portion 130, and a pair of rectangular ground planes 140. The radiation part 110 includes an annular first radiation segment 112, and a second radiation segment 114 disposed in the first radiation segment 112. The feed portion 130 and the ground planes 140 extend from an edge 152 of the substrate 150.

All constructions and functions of the second embodiment are the same as the aforementioned first embodiment, except that the radiation part 110 does not include any connecting portion; the feed portion 130 does not include any matching part; the second radiation segment 114 is zonal, and extends from a portion of contact of the first radiation segment 112 with the feed portion 130, and further, the second radiation segment 114 is coaxial with the feed portion 130; and lengths of the two ground planes 140 are different from each other, and widths of the two ground planes 140 are different from each other as well.

Figure 8:
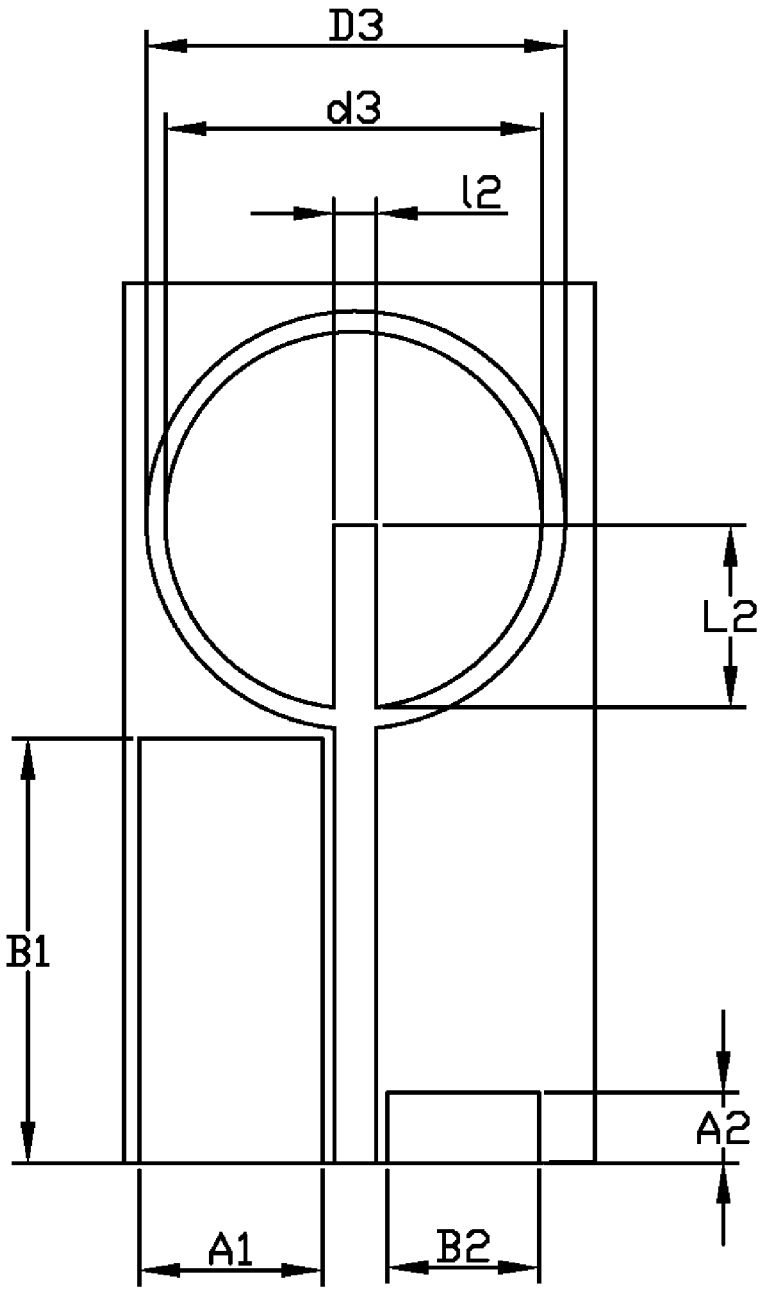
FIG. 8 is a schematic plan view illustrating dimensions of the broadband antenna of FIG. 7.

Referring to FIG. 8, an outside diameter D3 of the first radiation segment 112 is about 5.8 mm, and an inside diameter d3 of the first radiation segment 112 is about 5.225 mm. A length L2 of the second radiation segment 114 is about 5.4 mm, and a width 12 of the second radiation segment 114 is about 1.2 mm. A length of the feed portion 130 is about 12 mm and a width of the feed portion 130 is about 1.2 mm. The lengths B1 and B2 of the two ground planes 140 are respectively about 11.9 mm and 4.1 mm, and the widths A1 and A2 of the two ground planes 140 are respectively 5.05 mm and 2 mm.

Figure 9:
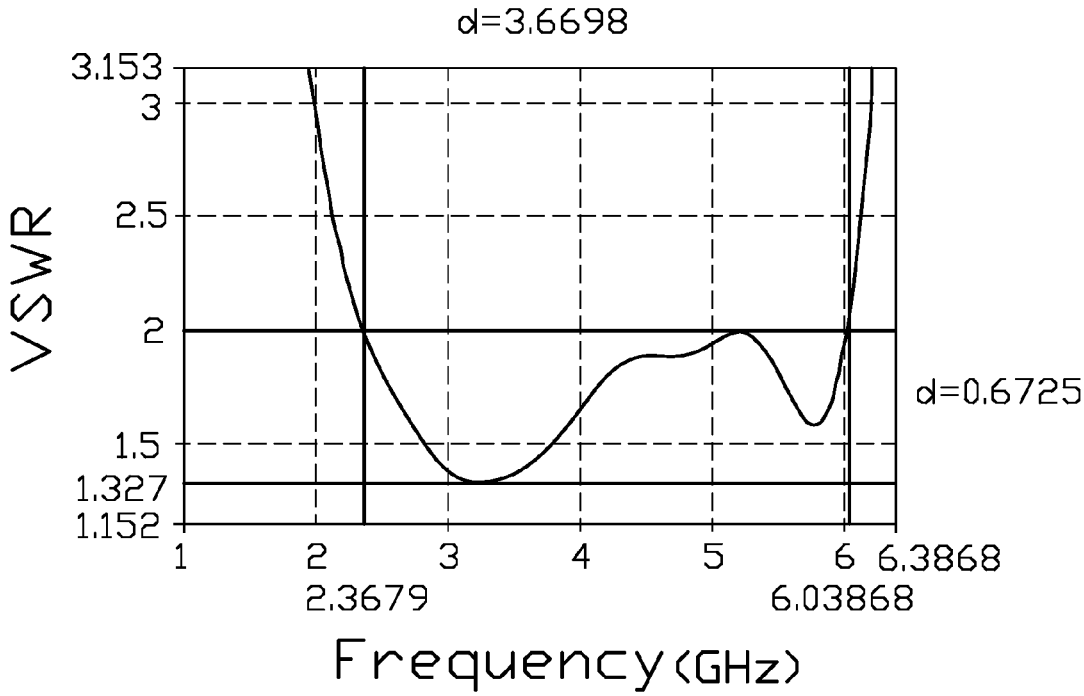
FIG. 9 is a graph of simulated test results showing VSWR of the broadband antenna of FIG. 7.

FIG. 9 is a graph of test results showing voltage standing wave ratio (VSWR) of the broadband antenna 200. A horizontal axis represents the frequency (in GHz) of the electromagnetic signals traveling through the broadband antenna 200, and a vertical axis indicated by a curve represents the amplitude of VSWR of the broadband antenna 200. As shown in FIG. 9, the broadband antenna 200 has a good performance when operating at frequency bands of 2.3679~9.5314 GHz. The amplitude values of the VSWR in the band pass frequency range are smaller than a value of 2, indicating that the broadband antenna 200 complies with application of 802.11n.

Figure 10:
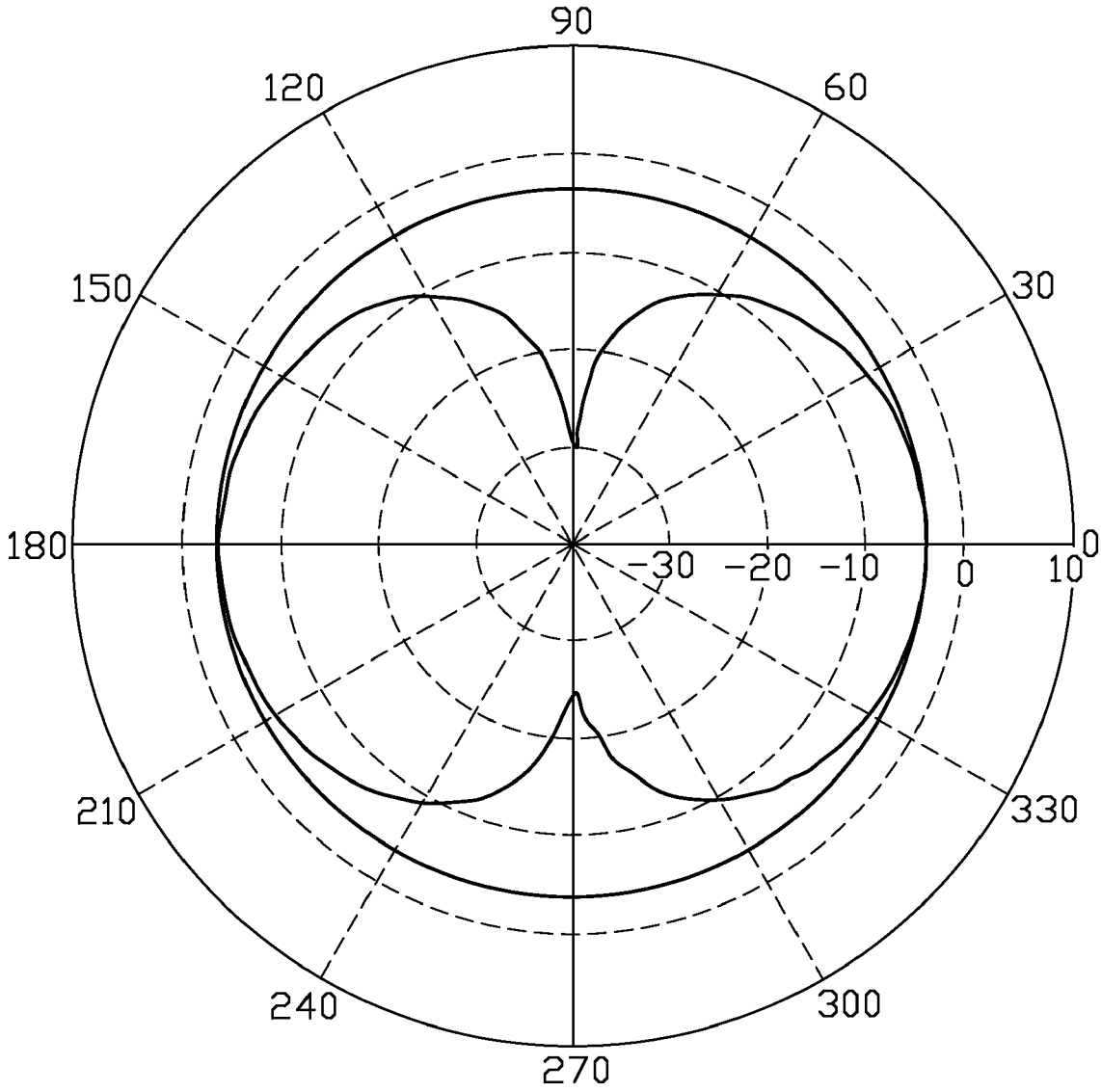
FIG. 10 is a graph of simulated test results showing a radiation pattern when the broadband antenna of FIG. 7 is operated at 2.4 GHz.
Figure 11:
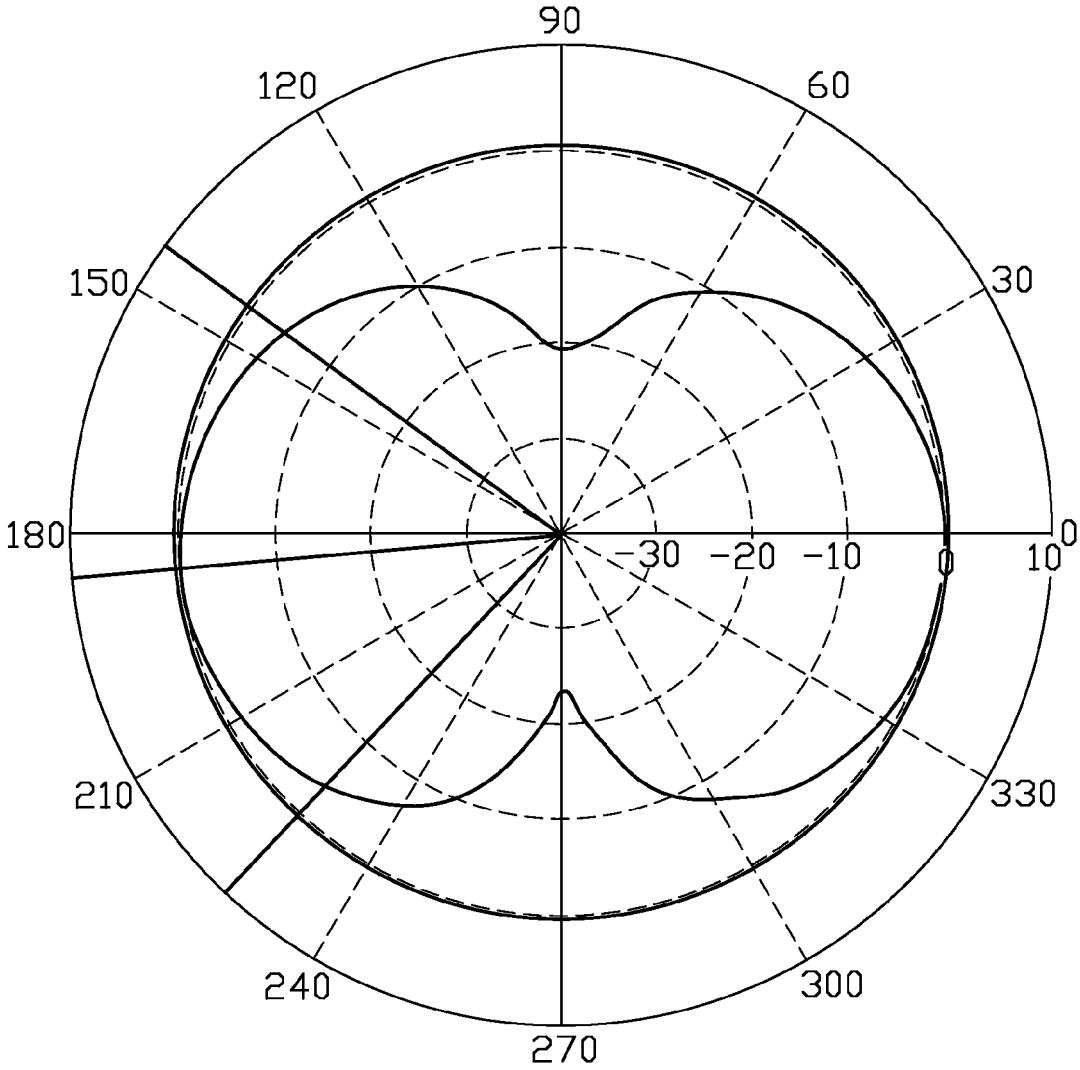
FIG. 11 is a graph of simulated test results showing a radiation pattern when the broadband antenna of FIG. 7 is operated at 4.9 GHz.
Figure 12:
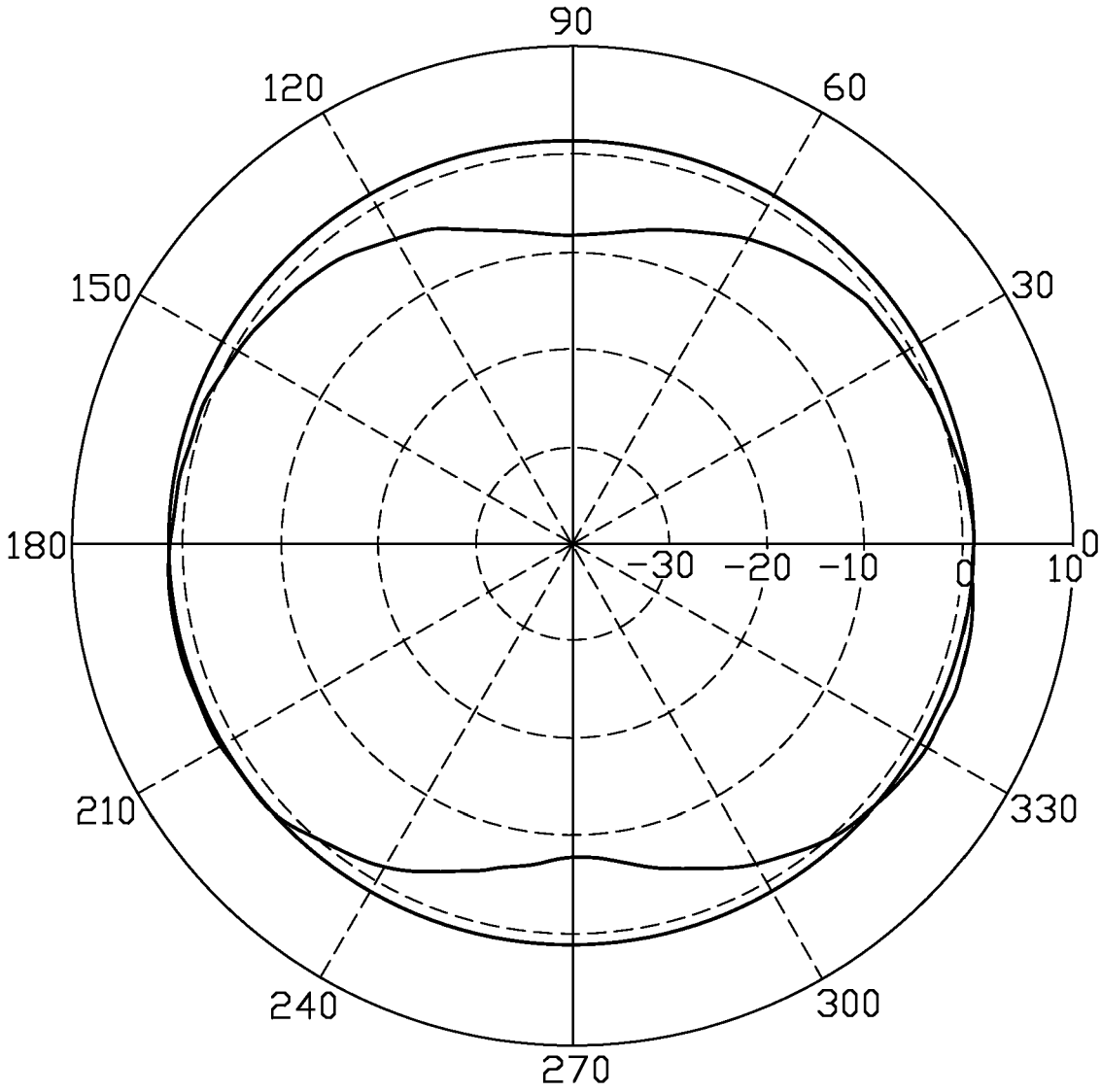
FIG. 12 is a graph of simulated test results showing a radiation pattern when the broadband antenna of FIG. 7 is operated at 6 GHz.

FIGS. 10~12 are graphs of test results showing a simulated radiation pattern in horizontal and vertical planes, when the broadband antenna 200 of FIG. 7 is operated respectively at 2.4 GHz, 4.9 GHz and 6 GHz. It is to be noted that except for a plane where the broadband antenna 200 is placed, the broadband antenna 200 has good radiation performance in each direction.

Figure 13:
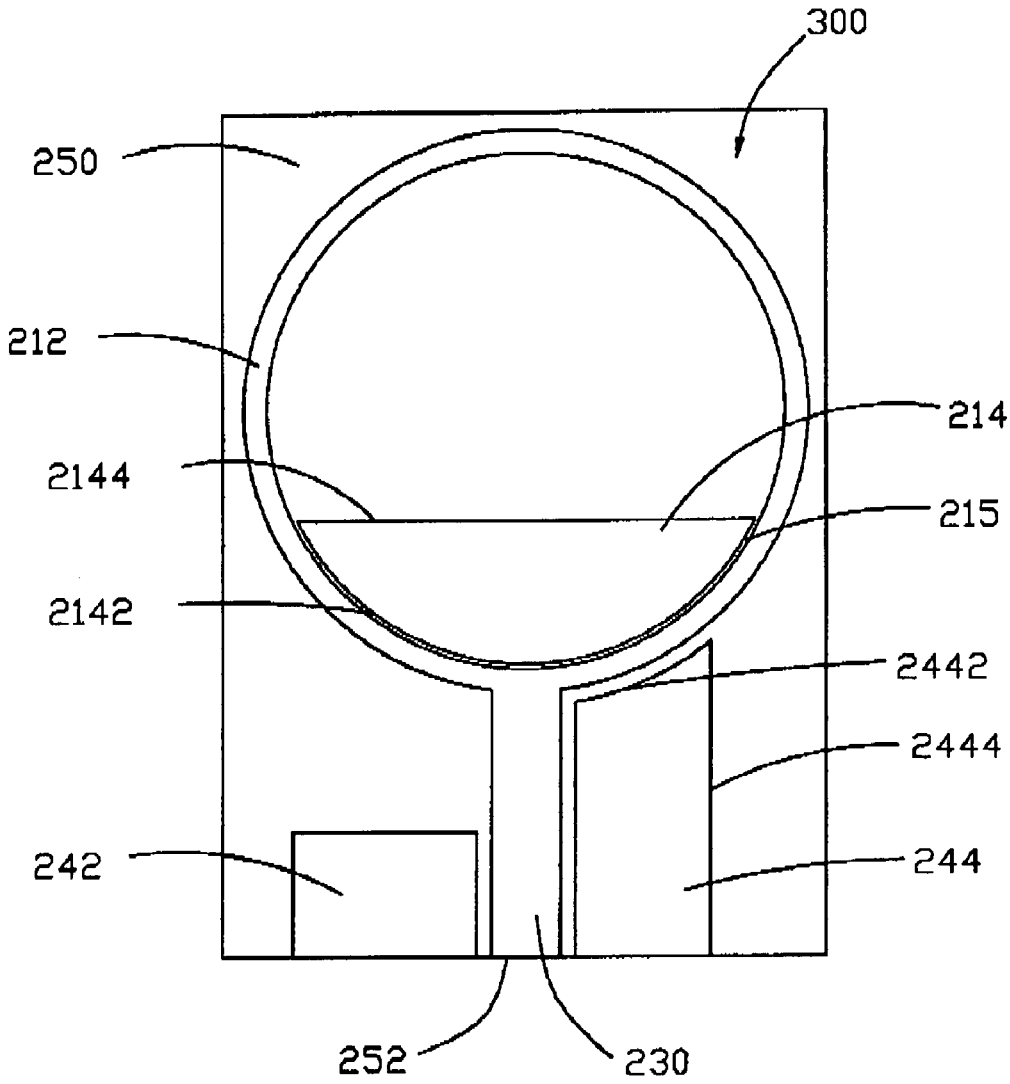
FIG. 13 is a schematic plan view of a broadband antenna of a third exemplary embodiment of the present invention.

Referring to FIG. 13, a broadband antenna 300 of a third embodiment is shown. The broadband antenna 300 is disposed on a surface of a substrate 250, and also includes an annular first radiation segment 212, a second radiation segment 214 disposed within a space defined by the annular shape of the first radiation segment 212, a pair of ground planes 242, 244, and a feed portion 230. The feed portion 230 and the ground planes 242, 244 extend from an edge 252 of the substrate 250. The second radiation segment 214 and the first radiation segment 212 are coaxial with the feed portion 230.

All constructions and functions of the third embodiment are the same as the first embodiment, except that the broadband antenna 300 does not comprise any connecting portion; the feed portion 230 does not include any matching part; the second radiation segment 214 is generally in a shape of a semicircle, and is separated from the first radiation segment 212 with an arcuate slot 215 formed between the first radiation segment 212 and the second radiation segment 214; the second radiation segment 214 comprises an arcuate edge 2142, and a straight edge 2144 with two ends respectively connected to two ends of the arcuate edge 2142; the straight edge 2144 is vertical to an axis of the feed portion 230; and the arcuate edge 2142 is parallel to the first radiation segment 212, and is more adjacent to the feed portion 230 than the straight edge 2144. In the illustrated embodiment, the second radiation segment 214 is generally in a shape of a segment on a chord of a circle.

The two ground planes 242, 244 are designated herein as a first ground plane 242 and a second ground plane 244. The first ground plane 242 is rectangular. The second ground plane 244 includes an arcuate edge 2442 parallel to the first radiation segment 212, and a pair of parallel straight edges 2444 extending from the edge 252 of the substrate 250. The two straight edges 2444 are respectively connected to two ends of the arcuate edge 2442, and are parallel to the axis of the feed portion 230. Lengths of the two parallel straight edges 2444 are both greater than that of an edge of the first ground plane 242 that is parallel to the feed portion 230.

Figure 14:
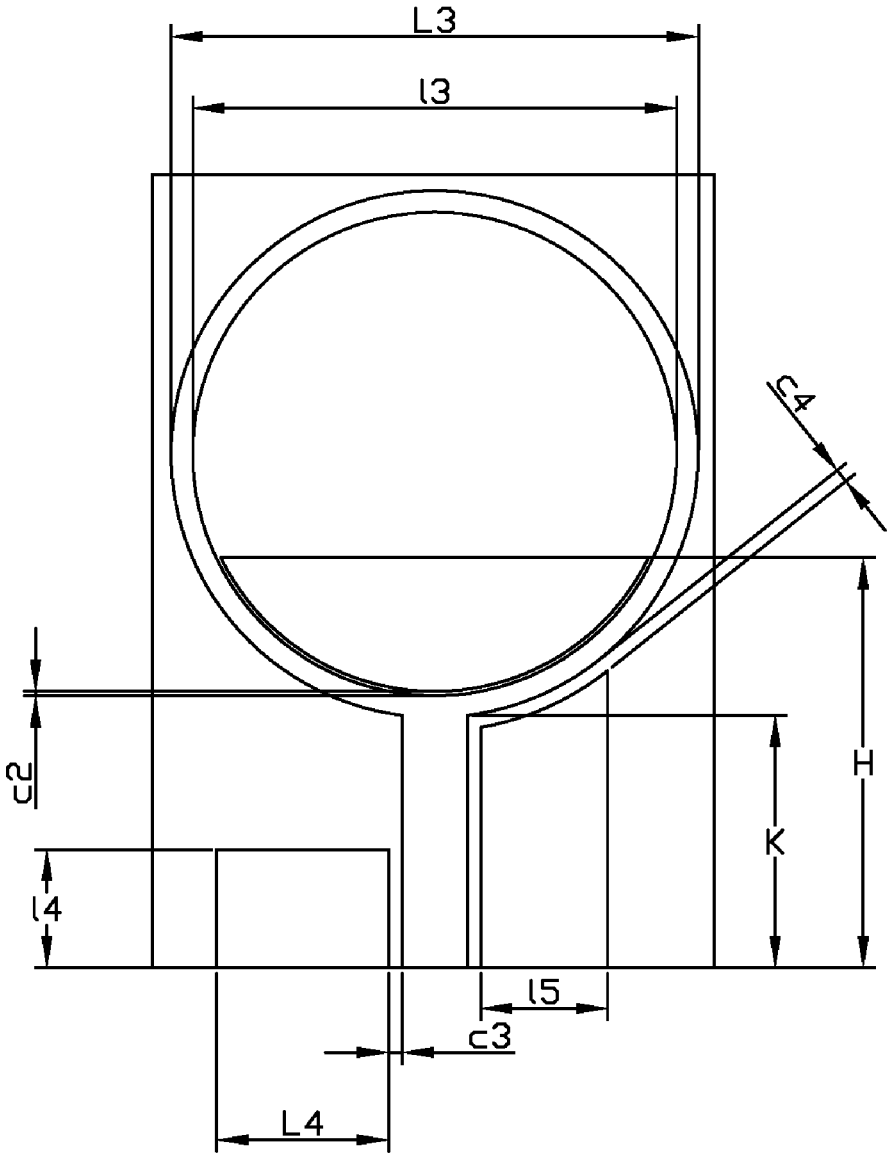
FIG. 14 is a schematic plan view illustrating dimensions of the broadband antenna of FIG. 13.

Referring to FIG. 14, in the third embodiment, an outside diameter L3 of the first radiation segment 212 is about 12.2 mm, and an inside diameter l3 is about 11.2 mm. A width c4 of a space between the first radiation segment 212 and the arcuate edge 2142 of the second radiation segment 214 is about 0.1 mm. A distance H between the straight edge 2144 of the second radiation segment 214 and the edge 252 of the substrate 250 is about 9.5 mm. A length K of the feed portion 230 is about 5.5 mm, and a width of the feed portion 230 is about 1.5 mm. A distance c3 between the feed portion 230 and each of the ground planes 242 and 244 is about 0.32 mm. A length L4 of the first ground plane 242 is about 3.97 mm, and a width 14 of the first ground plane 242 is about 2.375 mm. A width c4 of a space between the arcuate edge 2442 of the second ground plane 244 and the first radiation segment 212 is about 0.1 mm. A width l5 of the second ground plane 244 is about 2.93 mm.

Referring to FIG. 14, in the third embodiment, an outside diameter D4 of the first radiation segment 212 is about 12.2 mm, and an inside diameter d4 is about 11.2 mm. A width c4 of a space between the first radiation segment 212 and the arcuate edge 2142 of the second radiation 214 is about 0.1 mm. A distance H between the straight edge 2144 of the second radiation segment 214 and a hemline 252 of the substrate is about 9.5 mm. A length K of the feed portion 230 is about 5.8 mm, and a width J of the feed portion 230 is about 1.5 mm. A distance c3 between the feed portion 230 and each of the ground planes 242 and 244 is about 0.32 mm. A length L4 of the first radiation segment 242 is about 3.97 mm, and a width 14 of the first radiation segment 242 is about 2.375 mm. A width c4 of a space between the arcuate edge of the second ground plane 244 and the first radiation segment 212 is about 0.1 mm. A width L5 of the second ground plane 244 is about 2.93 mm.

Figure 15:
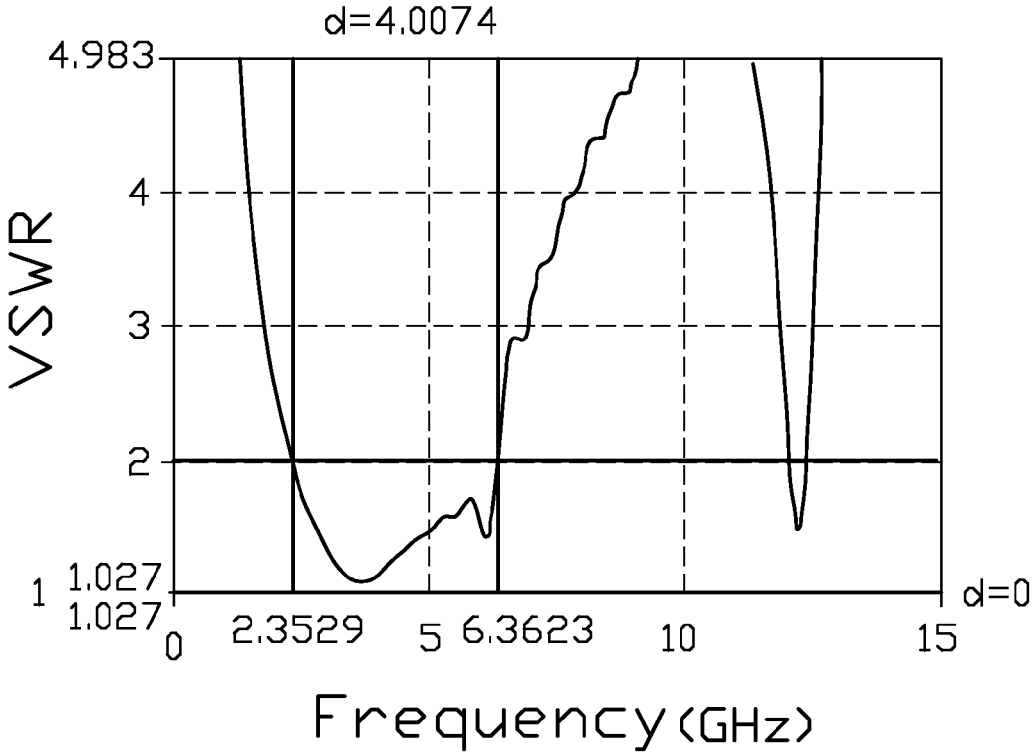
FIG. 15 is a graph of simulated test results showing VSWR of the broadband antenna of FIG. 13.

FIG. 15 is a graph of test results showing voltage standing wave ratio (VSWR) of the broadband antenna 300. A horizontal axis represents the frequency (in GHz) of the electromagnetic signals traveling through the broadband antenna 300, and a vertical axis indicated by a curve represents the amplitude of VSWR of the broadband antenna 300. As shown in FIG. 15, the broadband antenna 100 has a good performance when operating at frequency bands of 2.3529~6.3603 GHz. The amplitude values of the VSWR in the band pass frequency range are smaller than a value of 2, indicating that the broadband antenna 300 complies with application of 802.11n.

Figure 16:
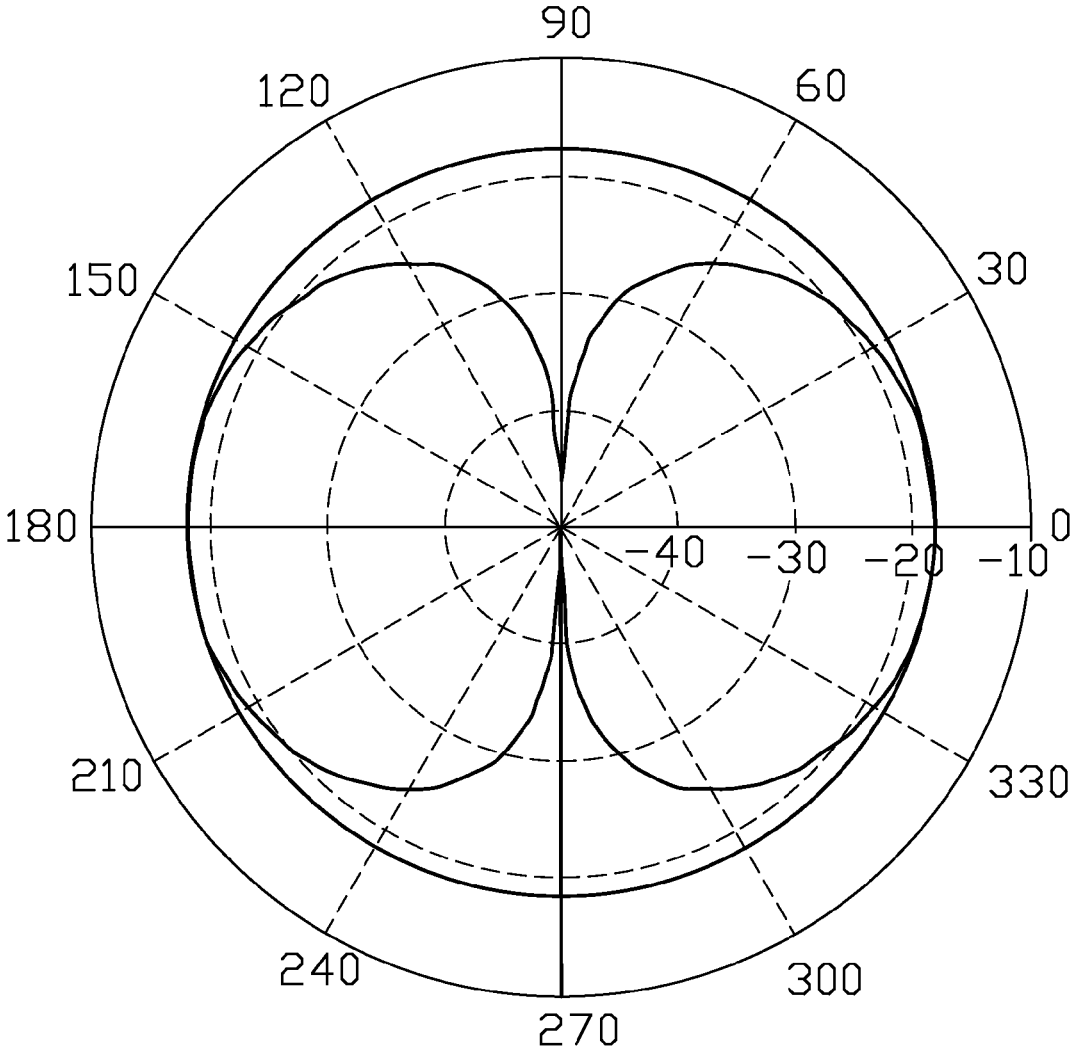
FIG. 16 is a graph of simulated test results showing a radiation pattern when the broadband antenna of FIG. 13 is operated at 2.4 GHz.
Figure 17:
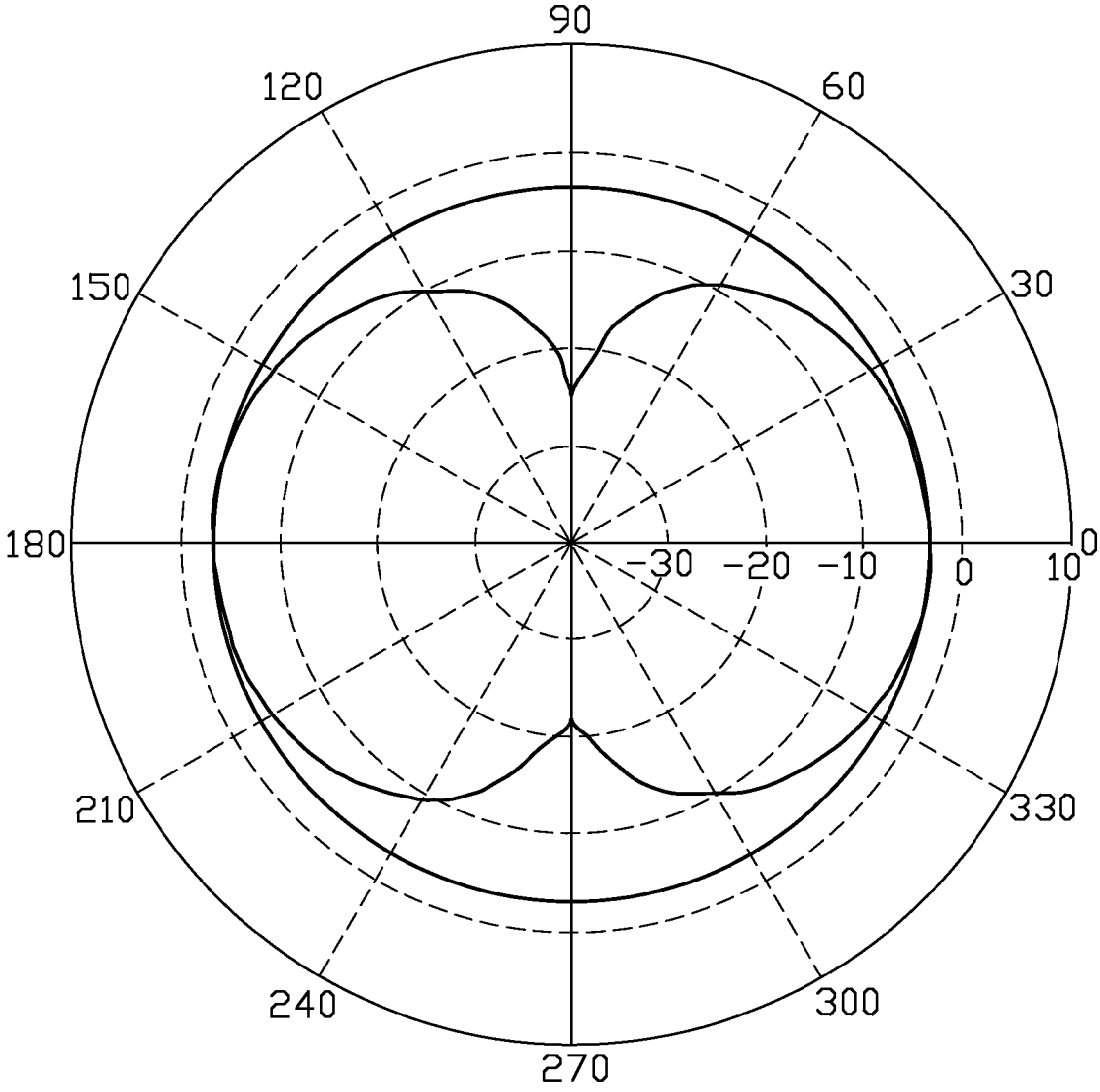
FIG. 17 is a graph of simulated test results showing a radiation pattern when the broadband antenna of FIG. 13 is operated at 4.9 GHz.
Figure 18:
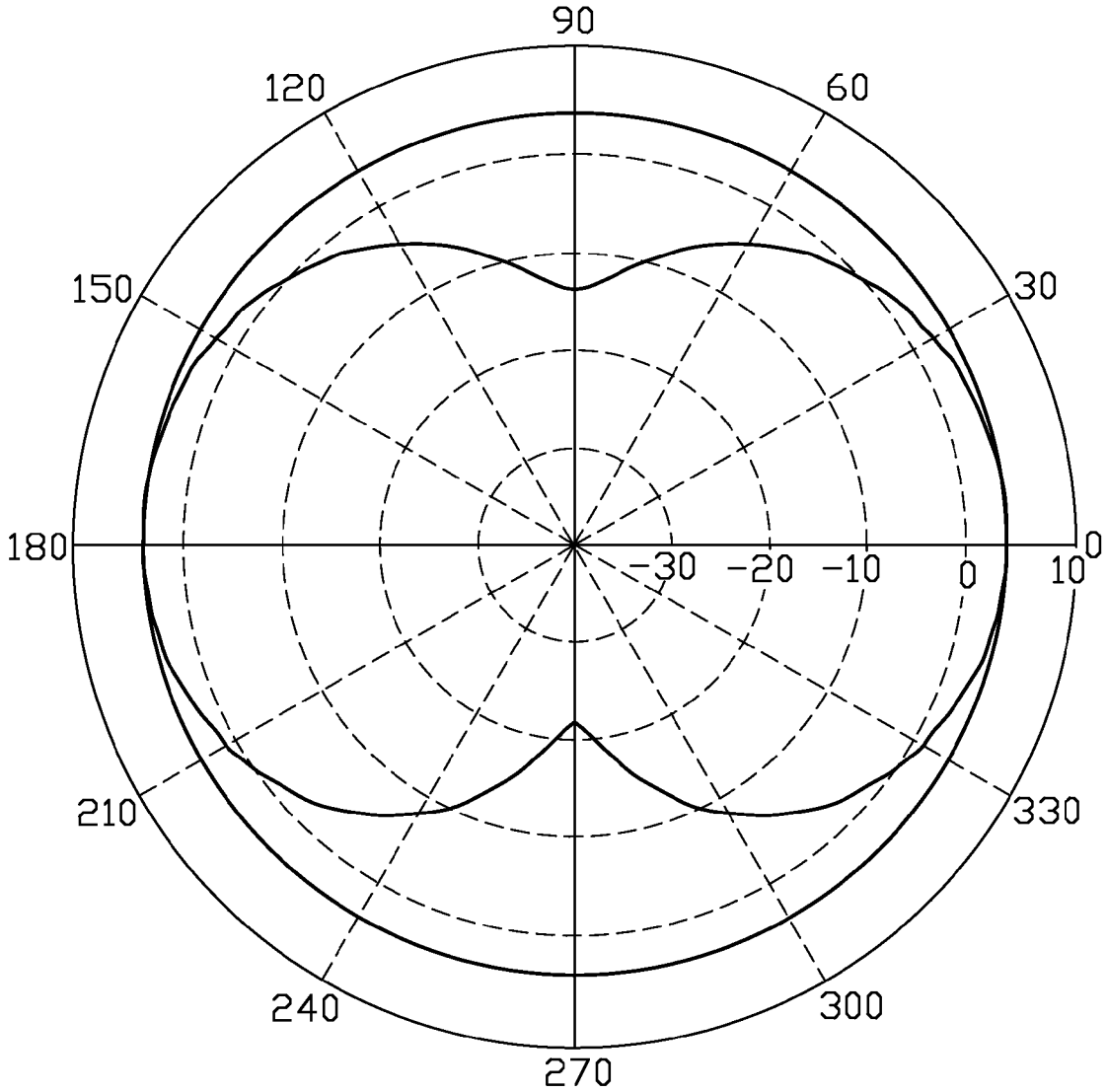
FIG. 18 is a graph of simulated test results showing a radiation pattern when the broadband antenna of FIG. 13 is operated at 6 GHz.

FIGS. 16~18 are graphs of test results showing a simulated radiation pattern in horizontal and vertical planes, when the broadband antenna 300 of FIG. 13 is operated respectively at 2.4 GHz, 4.9 GHz and 6 GHz. It is to be noted that except for a plane where the broadband antenna 300 is placed, the broadband antenna 300 has good radiation performance in each direction.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A broadband antenna, comprising:

a radiation part, for radiating and receiving electromagnetic signals, comprising an annular first radiation segment, and an annular second radiation segment being inscribed within a space defined by the annular shape of the first radiation segment;

a feed portion, electrically connecting with the radiation part, for feeding the electromagnetic signals to the radiation part; and a pair of ground planes, respectively disposed on sides of the feed portion.

2. The broadband antenna as claimed in claim 1, wherein a center of the first radiation segment and a center of the second radiation segment are both on an axis of the feed portion.

3. The broadband antenna as claimed in claim 1, wherein the radiation part further comprises a zonal connecting portion disposed outside of the second radiation segment but within the first radiation segment, two ends of the connecting portion respectively connecting with the first radiation segment and the second radiation segment.

4. The broadband antenna as claimed in claim 3, wherein an axis of the connecting portion is coaxial with an axis of the feed portion.

5. The broadband antenna as claimed in claim 1, wherein the two ground planes have same lengths and same widths.

6. A broadband antenna, comprising:

a radiation part, for radiating and receiving electromagnetic signals, comprising an annular first radiation segment, and a zonal second radiation segment disposed within a space defined by the annular shape of the first radiation segment, a feed portion, electrically connecting with the radiation part, for feeding the electromagnetic signals to the radiation part; and a pair of ground planes, respectively disposed on sides of the feed portion, wherein the second radiation segment extends from a point of contact of the first radiation segment with the feed portion.

7. The broadband antenna as clamed in claim 6, wherein a length of one of the two ground planes is greater than that of the other one, and a width of the longer ground plane is also greater than that of the shorter one.

8. The broadband antenna as claimed in claim 6, wherein the second radiation segment is coaxial to the feed portion.

9. A broadband antenna, comprising:

a radiation part, for radiating and receiving electromagnetic signals, comprising an annular first radiation segment, a second radiation segment generally in a shape of a semicircle disposed within a space defined by the annular shape of the first radiation segment, and an arcuate slot formed between the first radiation segment and the second radiation segment to separate the first radiation segment from the second radiation segment;

a feed portion, electrically connecting with the radiation part, for feeding the electromagnetic signals to the radiation part; and a pair of ground planes, respectively disposed on sides of the feed portion.

10. The broadband antenna as claimed in claim 9, wherein the second radiation segment comprises an arcuate edge, and a straight edge with two ends respectively connected to two ends of the arcuate edge, and the straight edge is vertical to an axis of the feed portion.

11. The broadband antenna as claimed in claim 10, wherein the arcuate edge is nearer to the feed portion than the straight edge.

12. The broadband antenna as claimed in claim 9, wherein one of the ground planes comprises an arcuate edge parallel to the first radiation segment, and a pair of parallel straight edges respectively connecting with two ends of the arcuate edge.

* * * * *